United States Patent [19]

Sawaki et al.

[11] Patent Number: 4,630,580

[45] Date of Patent: Dec. 23, 1986

[54] OIL PASSAGE USABLE FOR AN ENGINE

[75] Inventors: Yasushi Sawaki; Hironori Iguchi; Tateshi Shimizu, all of Shizuoka, Japan

[73] Assignee: Suzuki Motor Co., Ltd., Japan

[21] Appl. No.: 775,220

[22] Filed: Sep. 12, 1985

[30] Foreign Application Priority Data

Sep. 14, 1984 [JP] Japan ..... 59-193089

[51] Int. Cl.[4] ..... F01M 1/00

[52] U.S. Cl. ..... 123/196 R; 123/90.33; 123/90.38; 184/6.5

[58] Field of Search ..... 123/196 R, 90.37, 90.38, 123/90.33; 184/6.5

[56] References Cited

U.S. PATENT DOCUMENTS

| | | | |
|---|---|---|---|
| 2,306,554 | 12/1942 | Morehouse | 123/90.33 |
| 2,963,012 | 12/1960 | Kolbe | 123/90.38 |
| 3,824,973 | 7/1974 | Harhaus | 123/90.38 |
| 4,449,487 | 5/1984 | Krüger et al. | 123/196 R |
| 4,501,234 | 2/1985 | Toki et al. | 123/196 R |

*Primary Examiner*—E. Rollins Cross

*Attorney, Agent, or Firm*—Diller, Ramik & Wight

[57] ABSTRACT

An oil passage comprising at least one hydraulic communication means in the form of pipe which is disposed at the position located outwardly of the cylinder block of an engine so as to establish hydraulic communication between the cylinder head and the oil pan. Oil fed in the interior of the cylinder head is returned to the oil pan by way of the hydraulic communication means.

4 Claims, 16 Drawing Figures

OIL PASSAGE USABLE FOR AN ENGINE

BACKGROUND OF THE INVENTION

1. Field of the Invention

The present invention relates to an oil passage usable for an engine and more particularly to an oil passage usable for an engine, particularly, a four cycle internal combustion engine by way of which oil used in the interior of the cylinder head is smoothly returned to the crankcase.

2. Description of the Prior Art

As is hitherto known, oil supplied into the interior of the cylinder head is generally returned to the crankcase via a cam chain chamber formed in the cylinder block, stud bolt insert holes and the hollow space of the cylinder block after it lubricates operative parts in the valve actuating mechanism or the like arranged in the cylinder head or it cools them.

However, it has been pointed out as a drawback inherent to the conventional engine that oil is stirred by means of endless cam chain during returning to the crankcase via the cam chain chamber which constitutes a part of oil passage, resulting in air being entrapped in oil. Further, it has been found that as oil is scattered by means of the cam chain, a part of thus scattered oil is deposited on the valve actuating mechanism, causing an occurrence of mechanical loss relative to the latter, and another part of scattered oil is carried away together with blow-by gas, resulting in increased consumption of oil.

On the other hand, in the case where oil passage is constituted by a plurality of stud bolt insert holes there occurs a problem that a volume of oil to be returned is restricted because the diameter of insert holes can not be enlarged due to the geometrical configuration of the cylinder head and this leads to smooth returning of used oil to the crankcase being achieved only with much difficulties.

SUMMARY OF THE INVENTION

Hence, the present invention has been made with the foregoing backgrounds in mind and its object resides in providing an oil passage usable for an engine which assures that oil fed to the cylinder head is smoothly returned to the oil pan at an increased rate of flow and moreover an occurrence of air entrapping, mechanical loss caused by scattering of oil and increased consumption of oil are minimized.

Other object of the present invention is to provide an oil passage usable for an engine which assures that used oil to be returned is cooled by counterflowing air stream which is developed during running of a motorcycle without any deterioration of characteristics of oil.

To accomplish the above object there is proposed according to the present invention an oil passage usable for an engine, particularly, an internal combustion engine which is characterized in that at least one hydraulic communication means in the form of tube is disposed at the position located outwardly of the cylinder block of the engine so as to establish hydraulic communication between the cylinder head and the oil pan whereby oil fed to the cylinder head is returned to the oil pan through the hydraulic communication means.

In a preferred embodiment of the invention at least one main discharging passage is formed at the position located in the side part of the cylinder head and the one end of the hydraulic communication means is fitted to the main discharging passage.

Other objects, features and advantages of the present invention will become readily apparent from reading of the following description which has bcen prepared in conjunction with the accompanying drawings.

BRIEF DESCRIPTION OF THE DRAWINGS

The accompanying drawings will be briefly described below.

DESCRIPTION OF THE PREFERRED EMBODIMENTS

Now, the present invention will be described in a greater detail hereunder with reference to the accompanying drawings which illustrate an apparatus according to preferred embodiments thereof.

Figure 2:
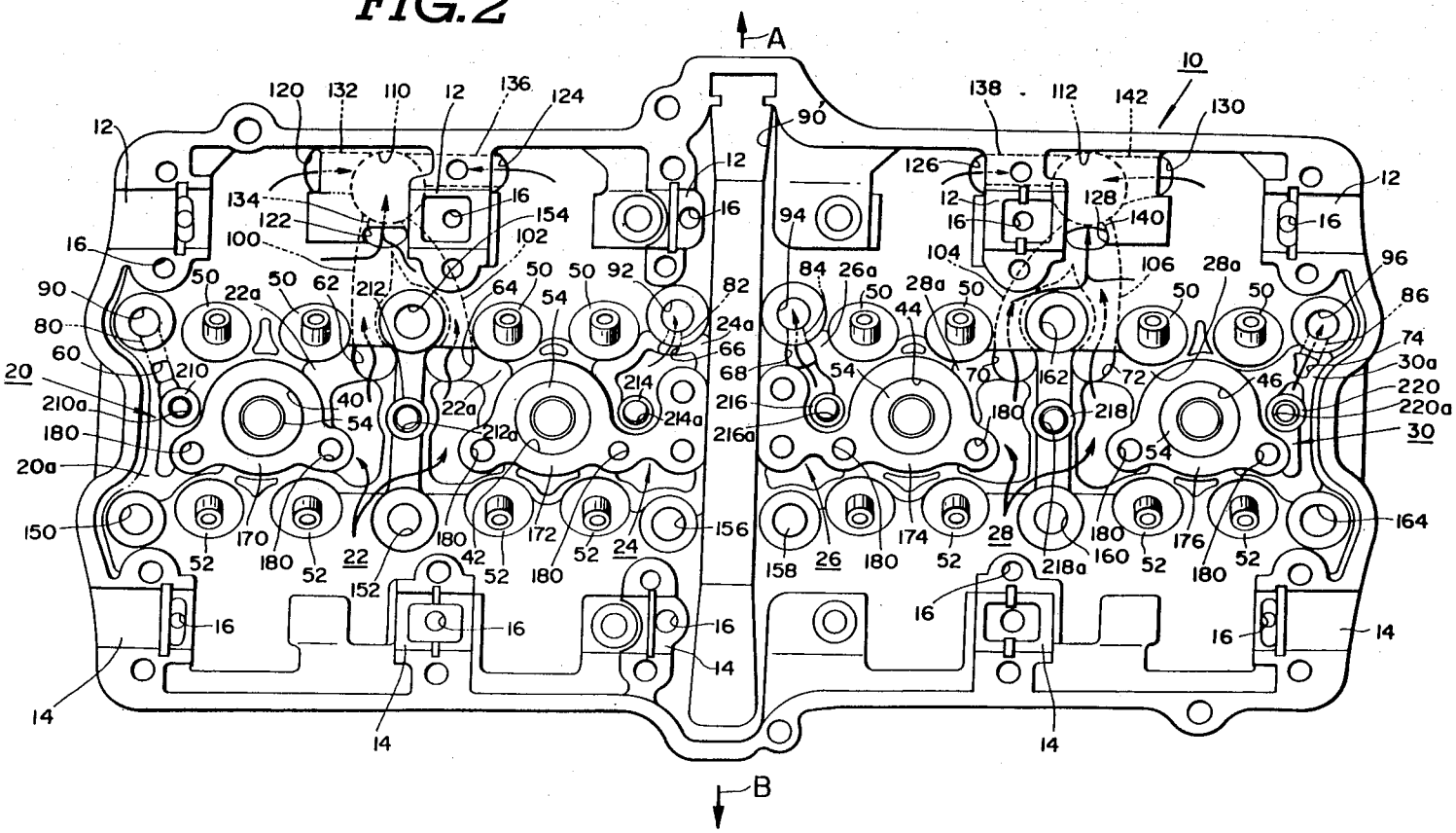
FIG. 2 is a plan view of the cylinder head with the oil passage of the invention incorporated therein, as seen from the above.
Figure 3:
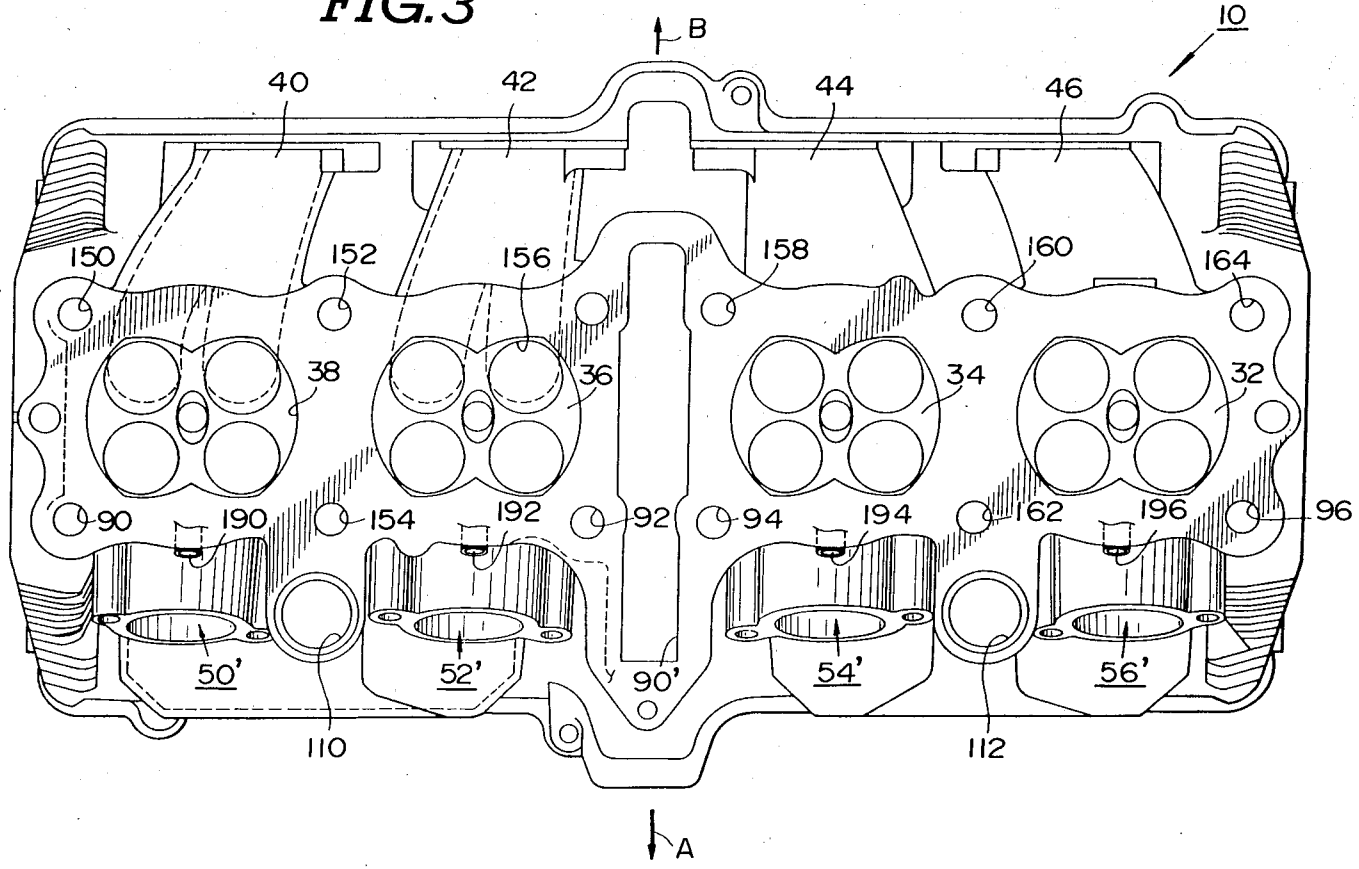
FIG. 3 is a plan view of the cylinder head in FIG. 2, as seen from the below.

FIGS. 2 and 3 are a plan view of a cylinder head 10 as seen from the above and the below respectively, in which oil passages according to the present invention are employed for the cylinder head 10, particularly for cylinder head used for a double overhead camshaft type engine preferably mounted on motorcycle.

As shown in FIG. 2, the cylinder head 10 is provided with bearing portions 12 and 14 for cam shafts (not shown) adapted to drive rocker arms. Specifically, the bearing portions 12 are located on the exhaust side (as identified by an arrow mark A), while the bearing portions 14 are located on the inlet port side (as identified by an arrow mark B). Further, the cylinder head 10 is provided with other bearing portions for rocker shafts (not shown) adapted to turnably support rocker arms on both the exhaust and inlet sides at the position located below the bearing portions 12 and 14.

As is apparent from FIG. 2, a plurality of lubricating oil spouting holes 16 through which pressurized lubricating oil (hereinafter referred to simply as oil) is pumped up via oil galleries (not shown) formed in the cylinder head 10 are disposed at the position located in the vicinity of the bearing portions 12 and 14.

Figure 4:
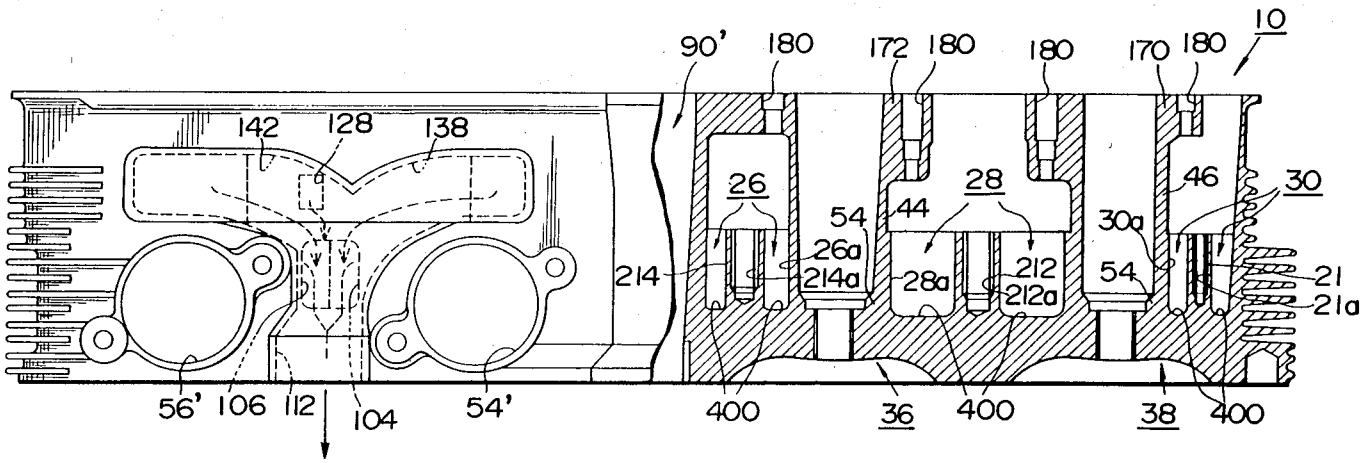
FIG. 4 is a partially sectioned front view of the cylinder head in FIG. 2.

Referring to FIG. 2 again, a plurality of recesses 20, 22, 24, 26, 28 and 30 are formed in the area extending in the longitudinal direction on the middle part of the inner surface of the cylinder head 10. Specifically, the recesses 20, 22, 24, 26, 28 and 30 are disposed at the position located approximately above combustion chambers 32, 34, 36 and 38 as illustrated in FIG. 3. Further, referring to FIG. 4 which is a partially sectioned front view of the cylinder head 10, the recesses 20, 22, 24, 26, 28 and 30 are formed in the area including the space as defined by the bore diameter of the combustion chambers 32, 34, 36 and 38 (but excluding the area occupied by cylindrical bosses 40, 42, 44 and 46 for mounting ignition plugs, the cylindrical bosses 40, 42, 44 and 46 being located above the central part of the combustion chambers 32, 34, 36 and 38). Thus, as shown in FIG. 2, the peripheral walls **20*a*, 22*a*, 24*a*, 26*a*, 28*a* and 30*a* of the recesses 20, 22, 24, 26, 28 and 30 are located adjacent to the peripheral walls of valve seats 50 for supporting exhaust valves and valve seats 52 for supporting inlet valves and moreover, as shown in FIG. 4, they are located adjacent to the peripheral walls of the ignition plug seats 54 provided for the combustion chambers 32, 34, 36 and 38. As oil is supplied into the recesses 20, 22, 24, 26, 28 and 30 formed in the above-described manner by an injection from oil feeding passages which will be described later, it is increasingly accumulated in each of the recesses 20, 22, 24, 26, 28 and 30 and a thermal boundary layer between each of the recesses and thus accumulated oil is then disturbed or broken whereby heat transmitted from the combustion chambers 32, 34, 36 and 38 (see FIG. 3), the valve seats 50 and 52 and the ignition plug seats 54 is absorbed by thus accumulated oil, resulting in the major part of the cylinder head 10 being cooled sufficiently. On the other hands, as shown in FIG. 2, the peripheral walls 20*a*, 22*a*, 24*a*, 26*a*, 28*a* and 30*a* of the recesses 20, 22, 24, 26, 28 and 30 are formed with a plurality of oil discharging holes 60, 62, 64, 66, 68, 70, 72 and 74 through which an excessive amount of oil accumulated in the recesses 20, 22, 24, 26, 28 and 30 is discharged continuously. Among them the oil discharging holes 60, 66, 68 and 74 in the recesses 20, 24, 26 and 30 formed at both the lefthand and righthand end parts of the cylinder head 10, as well as at the position located opposite to one another relative to a cam chain chamber 90', are communicated with stud bolt insert holes 90, 92, 94 and 96 via oil discharging passages 80, 82, 84 and 86. Accordingly, oil in the recesses 20, 24, 26 and 30 is caused to flow into the insert holes 90, 92, 94 and 96 through the discharging holes 60, 66, 68 and 74 and the discharging passages 80, 82, 84 and 86 and thereafter it is returned to an oil pan on the engine via the insert holes 90, 92, 94 and 96. On the other hands, the discharging holes 62, 64, 70 and 72 in the recesses 22 and 28 are communicated with main discharging passages 110 and 112 formed on the exhaust ports side via discharging passages 100, 102, 104 and 106. As illustrated in FIG. 4, the main discharging passages 110 and 112 are formed at the position located between the adjacent exhaust ports on the outer surface of the cylinder head 10. The discharging passages 100, 102, 104 and 106 are formed at the position located adjacent to the wall surface of the exhaust ports in the cylinder head 10. Owing to the arrangement made in that way heat developed in the exhaust ports is absorbed by oil in the recesses 22 and 28 while it is discharged into the main discharging passages 110 and 112 via the discharging passages 100, 102, 104 and 106** whereby the exhaust ports are cooled satisfactorily.

Figure 1:
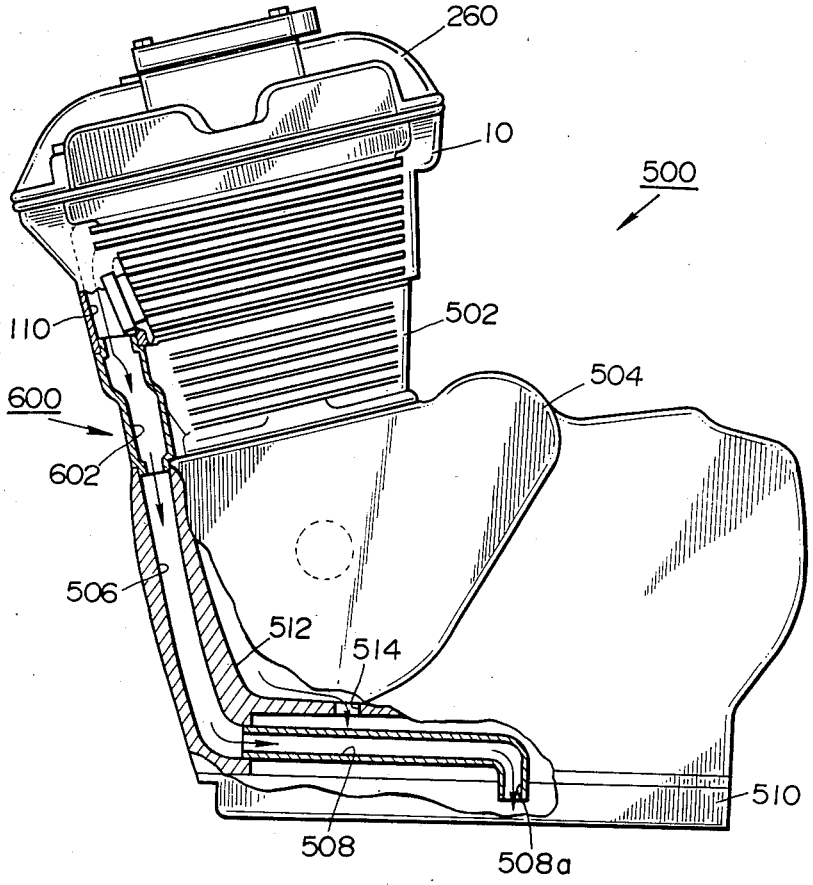
FIG. 1 is a partially sectioned side view of an engine with an oil passage of the invention attached thereto.
Figure 5:
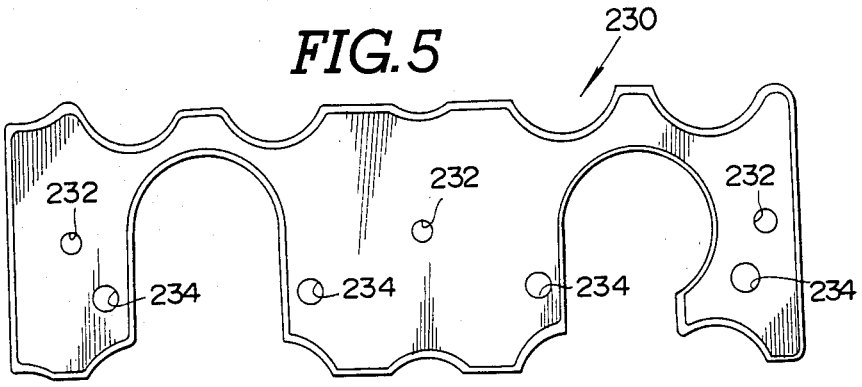
FIG. 5 is an enlarged plan view of a cover to be fitted to the cylinder head.
Figure 6:
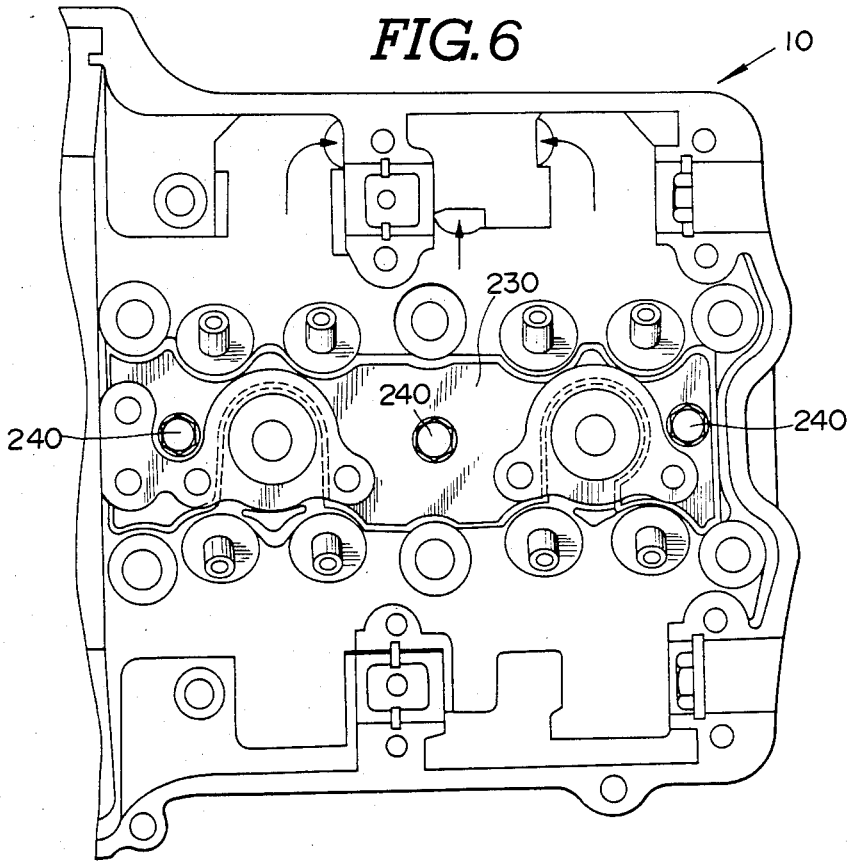
FIG. 6 is a plan view of the right half of the cylinder head with the cover fitted thereto, as seen from the above.
Figure 7:
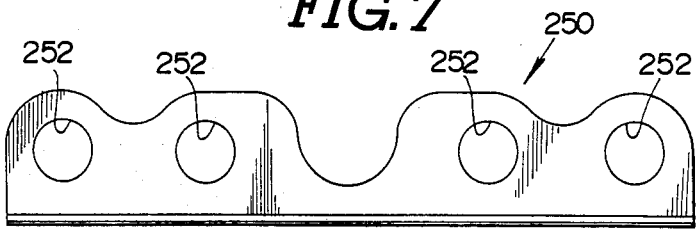
FIG. 7 is an enlarges plan view of a valve spring seat.
Figure 8:
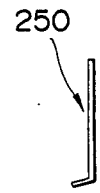
FIG. 8 is a side view of the valve spring seat in FIG. 7.
Figure 9:
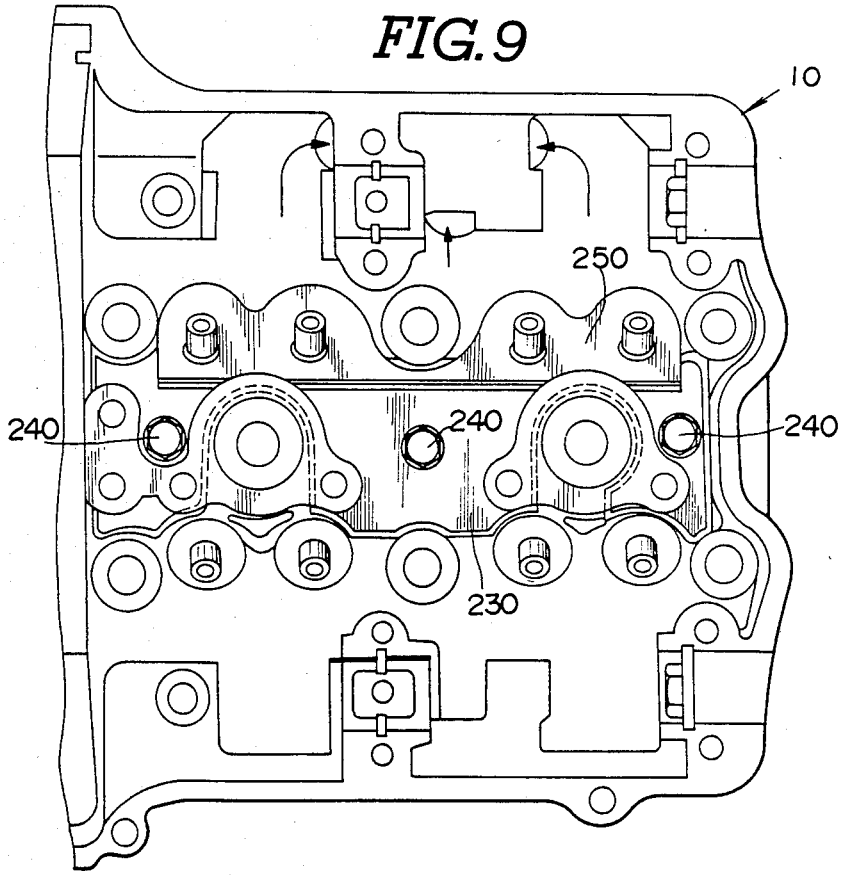
FIG. 9 is a plan view of the right half of the cylinder head with the valve spring seat attached thereto, as seen from the above.

In addition to the discharging passages 100, 102, 104 and 106 which are in communication with the recesses 22 and 28 the main discharging passages 110 and 112 are communicated with discharging passages 132, 134, 136, 138, 140 and 142 which include openings 120, 122, 124, 126, 128 and 130 on the inner surface of the cylinder head 10, causing oil flowing in the area located above the exhaust ports in the cylinder head 10 to be discharged into the main discharging passages 110 and 112 via the discharging passages 132, 134, 136, 138 and 140. Incidentally, in FIG. 2 reference numerals 150, 152, 154, 156, 158, 160, 162 and 164 designate stud bolt insert holes through which a stud bolt (not shown) is inserted, and reference numerals 170, 172, 174 and 176 identify a flange portion on the top of the ignition plug mounting bosses 40, 42, 44 and 46, respectively. Each of the flange portions 170, 172, 174 and 176 is formed with a hole 180 which constitutes a part of oil feeding passage to be described later through which oil is fed into the recesses 20, 22, 24, 26, 28 and 30. Further, in FIG. 3 reference numerals 190, 192, 194 and 196 designates a hole respectively, which is formed at the position located below the exhaust ports 50', 52', 54' and 65'. The holes 190, 192, 194 and 196 are communicated with the interior of the ignition plug mounting bosses 40, 42, 44 and 46 as shown in FIG. 2. Referring to FIGS. 4 and 2 again, reference numerals 210, 212, 214, 216, 218 and 220 designate a boss standing upright in the recesses 20, 22, 24, 26, 28 and 30 respectively. The bosses 210, 212, 214, 216, 218 and 220 are formed with female threads **210*a*, 212*a*, 214*a*, 216*a*, 218*a* and 220*a* (see FIG. 2). The female threads 210*a*, 212*a*, 214*a*, 216*a*, 218*a* and 220*a* are adapted to function as female portions for fastening a plate-shaped cover 230 as shown in FIG. 5 in an enlarged scale. The configuration of the cover 230 is designed to independently cover the lefthand area as defined by the group of recesses 20, 22 and 24 and the righthand area as defined by the group of recesses 26, 28 and 30, both the areas being located symmetrical relative to the cam chain chamber 90' as seen in FIG. 2. Incidentally, the cover 230 has the inverted U-shaped cross-sectional configuration in order to assure increased mechanical strength. Further, the cover 230 is formed with fitting bolt insert holes 232 and pipe fitting holes 234 through which a pipe constituting oil feeding passage to be described later is inserted. Thus, when the thus designed covers 230 are assembled on the cylinder head 10 as illustrated in FIG. 2, all the recesses 20, 22, 24, 26, 28 and 30 are covered with them, as shown in FIG. 1 which is an enlarged partial plan view of the cylinder head 10. Once the recesses 20, 22, 24, 26, 28 and 30 are covered with the cover 230 in that way, it is assured that oil held in them is inhibited from being scattered inwardly of the cylinder head 10. In FIG. 6 reference numerals 240 designate a fitting bolt respectively, by means of which the covers 230 are fastened to the cylinder head 10. Further, in order to inhibit an excessive amount of oil from being deposited on exhaust valves, valve springs or the likes, plate-shaped seats 250 are fastened to the cylinder head 10, as shown in FIG. 7 which is an enlarged plan view of the valve spring seat and FIG. 8 which is a side view of the same. As is apparent from FIG. 6, each of the valve spring seats 250 is formed with a plurality of valve guide insert holes 252 and it has the L-shaped cross-sectional configuration so as to assure increased mechanical strength. FIG. 9 is a partial plan view particularly illustrating how the valve spring seats 250 are fastened to the inside of the cylinder head 10 and same parts as those in FIGS. 2 and 6 are identified by same reference numerals. It should be noted that the valve spring seat 250** is immovably held on the valve seat by means of valve springs (not shown) in such a manner that a plurality of valve guides are simultaneously fitted through a single sheet of plate, resulting in any occurrence of underdesirable turning movement of the valve spring seat as is seen with the conventional circular disc-shaped valve seat being prevented.

Next, description will be made in more details as to the oil feeding passages through which oil is fed to the recesses 20, 22, 24, 26, 28 and 30 on the cylinder head 10.

Figure 10:
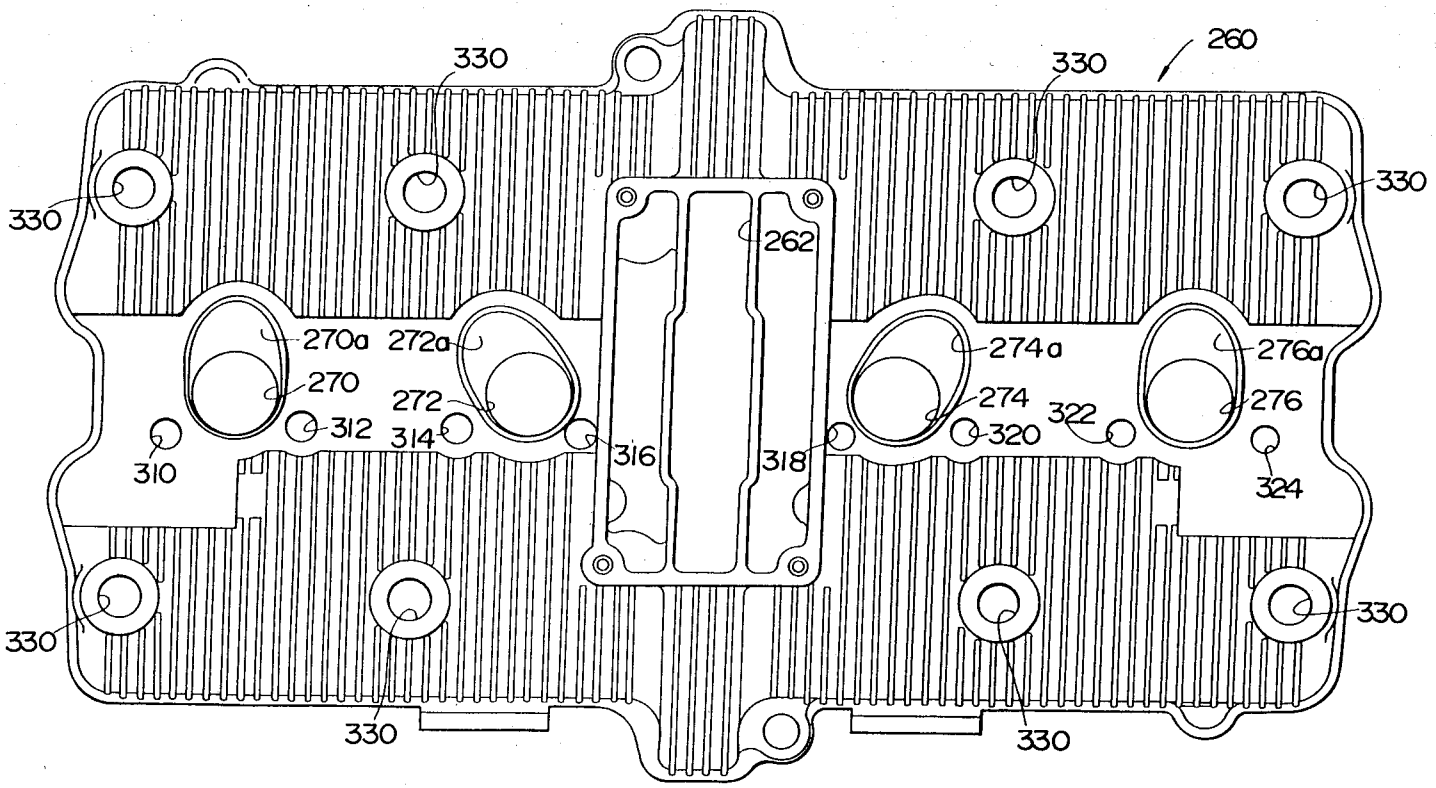
FIG. 10 is a plan view of the cylinder head cover, as seen from the above.
Figure 11:
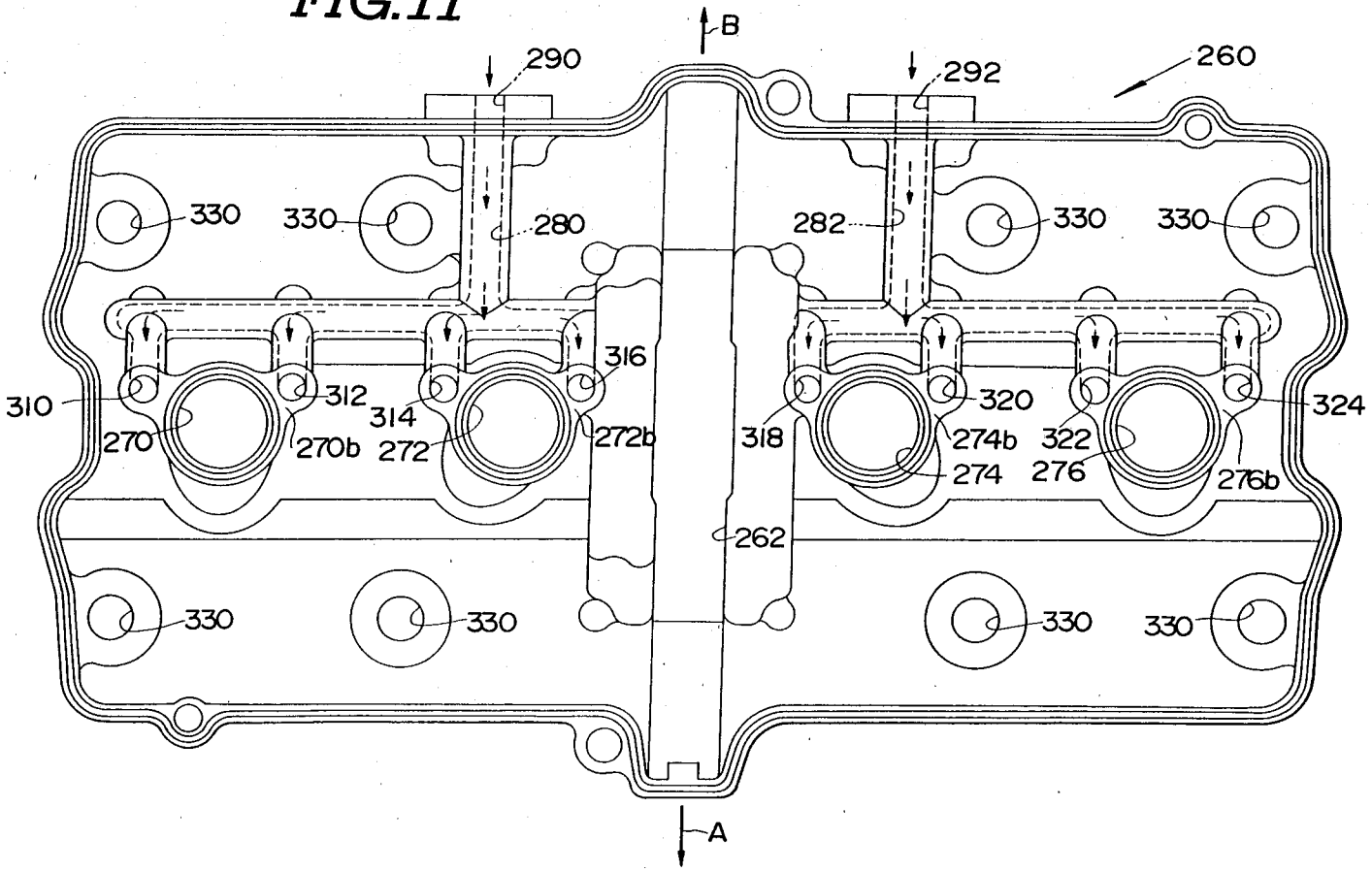
FIG. 11 is a plan view of the cylinder head cover in FIG. 10, as seen from the below.

FIGS. 10 and 11 are a plan view of a cylinder head cover 260 as seen from the above and below respectively, with which the cylinder head 10 as shown in FIG. 2 is covered.

Figure 12:
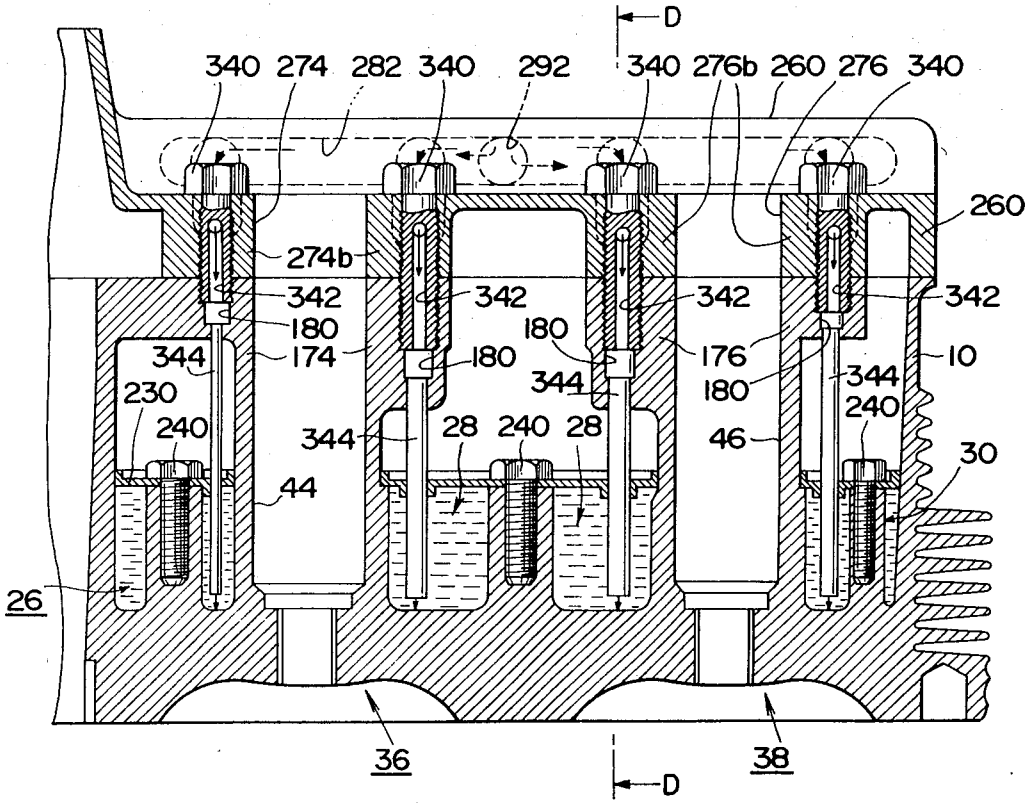
FIG. 12 is a fragmental vertical sectional view of the right half of the cylinder head with the cylinder head cover firmly mounted thereon.
Figure 13:
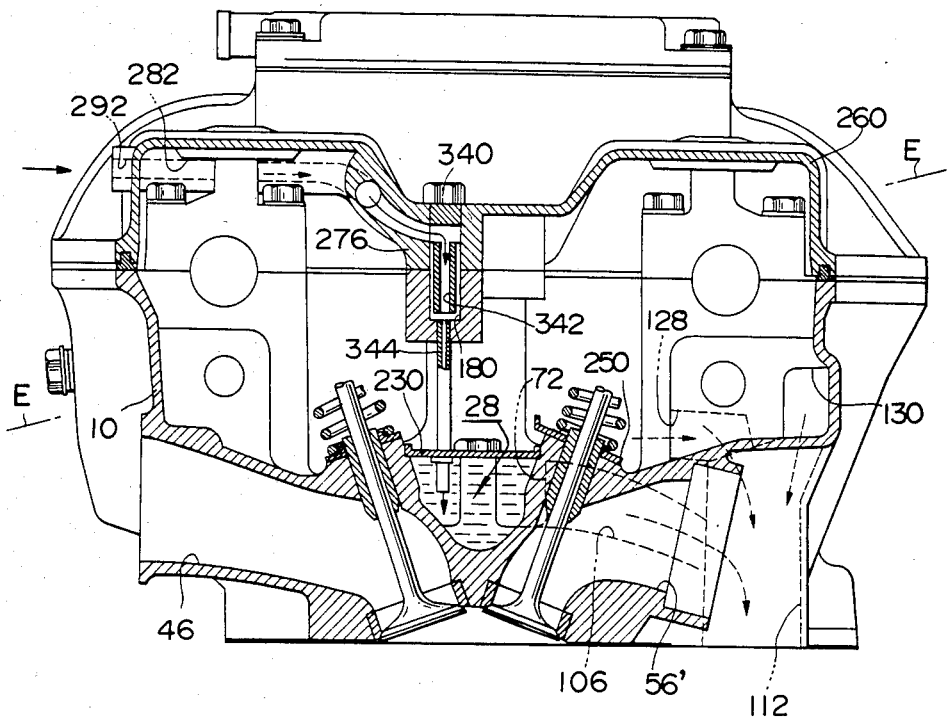
FIG. 13 is a vertical sectional view of the combination of cylinder head and cylinder head cover, taken in line D—D in FIG. 12.
Figure 14:
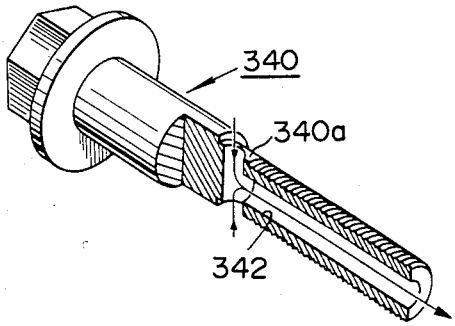
FIG. 14 is a partially sectioned perspective view of a cylinder head fastening bolt, shown in an enlarged scale.

The cylinder head cover 260 is designed in the plate-shaped configuration so as to fully cover the whole surface of the cylinder head 10 and it is formed with an opening 262 at the central part thereof through which blow-by gas is taken out. Further, it is formed with a plurality of insert holes 270, 272, 274 and 276 through which ignition plugs and ignition plug fitting and removing tools are inserted, the insert holes 270, 272, 274 and 276 being arranged at the central part thereof as seen in the longitudinal direction on the drawings. Incidentally, inclined guide grooves **270*a*, 272*a*, 274*a* and 276*a* are formed on the inner wall of the insert holes 270, 272, 274 and 276. As shown in FIG. 11, oil feeding passages 280 and 282 through which oil pumped up from an oil supply source (not shown) is introduced into the central part of the cylinder head cover 260 are formed on the bottom surface of the head cover 260. The one ends of the oil feeding passages 280 and 282 are communicated with feeding ports 290 and 292 on the inlet port side of the cylinder head cover 260, whereas the other ends of the same are branched to reach flange portions 270*b*, 272*b*, 274*b* and 276*b* on the insert holes 270, 272, 274 and 276. The flange portions 270*b*, 272*b*, 274*b* and 276*b* have insert holes 310, 312, 314, 316, 318, 320, 322 and 324 formed thereon through which fastening bolts (which will be described later) for immovably fastening the cylinder head cover 260 to the cylinder head (see FIG. 2) are inserted and the other ends of the branched parts of the oil feeding passages 280 and 282 are communicated with the insert holes 310, 312, 314, 316, 318, 320, 322 and 324. Owing to the arrangement made in that way, as oil is fed through the feeding ports 290 and 292 as represented by arrow marks on the drawing, it flows in the oil feeding passages 280 and 282 to reach the insert holes 310, 312, 314, 316, 318, 320, 322 and 324. It should be noted that the insert holes 310, 312, 314, 316, 318, 320, 322 and 324 are located opposite to the holes 180 on the flange portions 170, 172, 174 and 176 of the bosses 40, 42, 44 and 46. Incidentally, in FIGS. 10 and 11 reference numerals 330 designate an insert hole respectively, through which a fastening bolt is inserted to immovably fasten the cylinder head cover 260 to the cylinder head 10 (see FIG. 2). After oil reaches the insert holes 310, 312, 314, 316, 318, 320, 322 and 324 on the cylinder head cover 260, it flows through oil passages 342 formed in the fastening bolts 340 and pipes 344 fitted into the holes 180 on the flange portions 170, 172, 174 and 176 as shown in FIG. 12 which is an enlarged fragmental sectional view of the cylinder head cover 260 fastened to the cylinder head 10 and FIG. 13 which is a cross-sectional view of the cylinder head 10 and the cylinder head cover 260 taken in line D—D in FIG. 12. Thereafter, it is supplied into each of the recesses 20, 22, 24, 26, 28 and 30 on the cylinder head 10. As mentioned above, in the embodiment as illustrated in FIG. 13 oil is introduced into the recesses 20, 22, 24, 26, 28 and 30 via the holes 180 on the flange portions 170, 172, 174 and 176 and the pipes 344 but the present invention should not be limited only to this. Alternatively, arrangement may be made such that the flange portions 170, 172, 174 and 176 are extended until they reach the recesses 20, 22, 24, 26, 28 and 30 and an oil passage is drilled through each of the flange portions 170, 172, 174 and 176 without any use of pipes such as the pipes 344. In the case of a fastening bolt 340 as illustrated in FIG. 14 by way of enlarged sectional perspective view it is formed with a T-shaped oil passage 342 so that oil is introduced toward the lowermost end through the oil passage 342 after entrance from the peripheral surface 340*a* of the bolt 340 as represented by arrow marks. Incidentally, parts in FIGS. 12 and 13 as those in FIGS. 2, 4, 6, 9 and 11 are identified by same reference numerals. After oil is supplied into each of the recesses 20, 22, 24, 26, 28 and 30 on the cylinder head 10, it is discharged into the insert holes 90, 92, 94 and 96 or the main discharging passages 110 and 112 via the discharging holes 60, 62, 64, 66, 68, 70, 72 and 74 (see FIG. 2) on the peripheral walls 20*a*, 22*a*, 24*a*, 26*a*, 28*a* and 30*a* of the recesses 20, 22, 24, 26, 28 and 30**.

It should be noted that an engine mounted on motorcycle is usually mounted thereon in the forwardly inclined posture as seen in the direction of running due to a requirement for reducing the height of the body as far as possible. For the reason the cylinder head 10 is held in such an inclined state that the exhaust port side is lowered as represented by a horizontal line E—E in FIG. 13 whereby oil discharged into the cylinder block after slidable components such as cam shafts or the like are lubricated properly is caused to flow into the discharging holes 120, 122, 124, 126, 128 and 130 as shown in FIG. 2 in the same manner as oil temporarily accumulated in the recesses and thereafter it is discharged into the main discharging passages 110 and 112 via the discharging holes.

Figure 15:
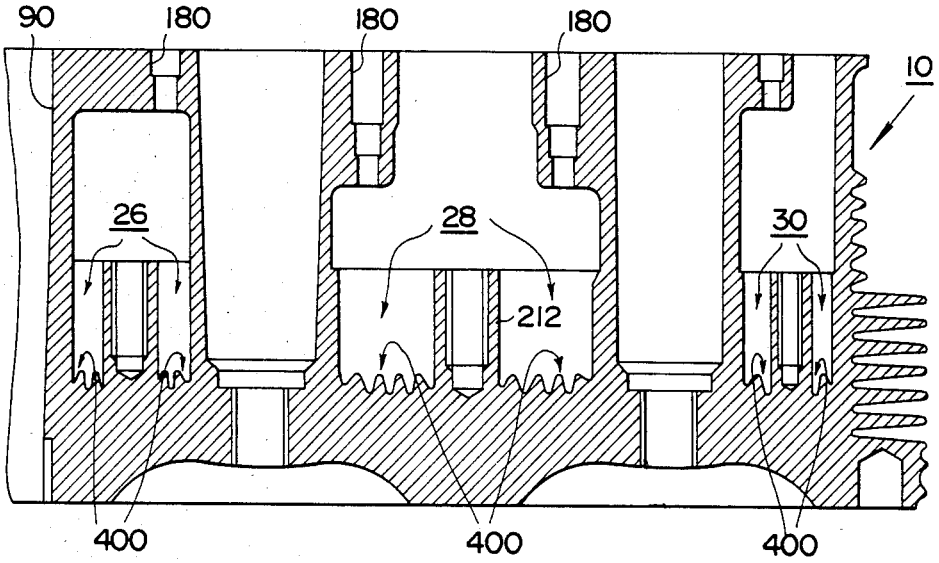
FIG. 15 is a fragmental vertical sectional view of the right half of the cylinder head, particularly illustrating how each of the recesses has a rugged bottom surface.
Figure 16:
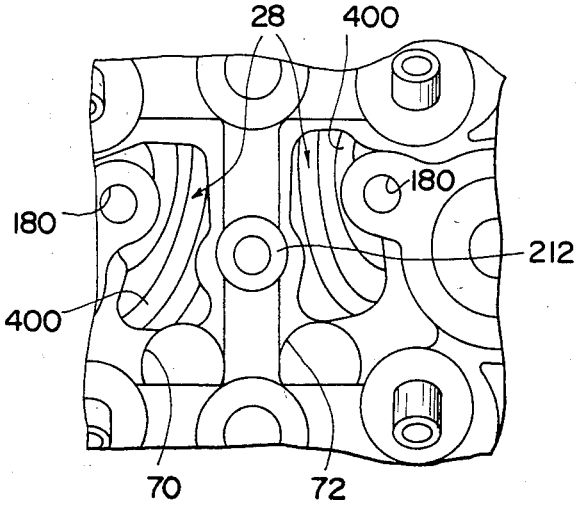
FIG. 16 is a fragmental plan view of the cylinder head in FIG. 15, particularly illustrating how a number of ridge lines on the recesses extend.

In the above-described embodiment each of the recesses 20, 22, 24, 26, 28 and 30 has a flat bottom surface 400 which extends substantially in parallel with the upper surface of the associated combustion chamber, as shown in FIG. 4. However, the present invention should not be limited only to this. Alternatively, each of the recesses 20, 22, 24, 26, 28 and 30 may have a rugged bottom surface in order to increase contact area over which oil temporarily accumulated in the recess comes in surface contact with the associated bottom surface 400 and thereby assure increased cooling effect in the presence of oil, as shown in FIG. 15 which is a fragmental enlarged vertical sectional view. Also in this embodiment same parts as those in FIG. 4 are identified by same reference numerals. In addition to this a number of ridge lines on the rugged bottom surface may have specific directional configuration, as shown in FIG. 16 which is a fragmental plan view of FIG. 15. This embodiment is intended to allow oil to smoothly flow toward the discharging holes.

As will be apparent from FIG. 1 which schematically illustrates an engine 500 by way of side view, oil is returned into the interior of a crankcase 504 via the main discharging passages 110 and 112 on the cylinder head 10 and the oil passages 600 of the invention which are provided independently of the cylinder block 502.

Specifically, each of the oil passages 600 is constituted by a combination of pipe 602 of which upper end is fitted to the main discharging passage 110 and oil passage 506 formed in the crankcase 504. Incidentally, things are same with the main discharging passage 112 which is not shown in FIG. 1. Namely, arrangement is made such that the oil passage on the side wall of the cylinder block 502 is communicated with the oil passage in the crankcase 504. Owing to the arrangement made in that way almost of oil which has been fed to the cylinder head 10 is returned to the interior of the crankcase via the main discharging passages 110 and 112 and the pipes 602. As is apparent from FIG. 1, another pipe 508 is fitted into the other end of each of the oil passages 506 and the other end 508*a* of the pipe 508 is located at the position in the proximity of the oil pan 510. Thus, oil discharged through the oil passage 514 by way of which the crankcase 512 is communicated with the oil pan 510 and oil returned to the oil pan 510 from the cylinder head 10 via the oil passages of the invention are smoothly discharged into the interior of the oil pan 510 without any occurrence of interference therebetween. The fitting part where the pipe 602 is fitted into the main discharging passage 110 and the fitting part where the pipe 602 is fitted into the oil passage 506 in the crankcase 504 are equipped with a sealing member such as O-ring or the like means whereby the pipe 602 is leaklessly communicated with the passages 110 and 506. In the case where openings through which cooling air is introduced are formed at the position located between the adjacent cylinder chambers it should of course be understood that care should be taken so as not to allow each of the pipes 602 to assume the position in front of the opening.

As will be obvious for any expert in the art, various changes or modifications may be made for the invention in any acceptable manner without departure from the spirit and scope of the invention. Accordingly, it should be considered that the above-described embodiments are merely illustrative and therefore they should not be interpreted limitatively. After all, the scope of the invention is as defined by the claim clause without any restriction or limitation being effected by the description of the specification. Finally, it should be understood that all changes or modifications falling under scope of the claim clause should be construed within the scope of the invention.

What is claimed is:

1. An internal combustion engine comprising a valve actuating mechanism, a cylinder head having a recess formed around an ignition plug seat, said recess being defined by a peripheral wall, a cover covering said recess, means for injecting oil from an oil pan into said recess without passing through said valve actuating mechanism to thereby cool said cylinder head, oil passage means including a main discharge passage provided in said cylinder head with one end of said main discharging passage being in communication with said recess at a lower portion of said peripheral wall and with another end of said main discharging passage being led to a side face of said cylinder head, and pipe means with one end thereof being in communication with said main discharging passage other end and extending into oil accumulated in said oil pan whereby oil injected into said recess is returned below the surface of oil accumulated in said oil pan.

2. The internal combustion engine as defined in claim 1 wherein said oil pan is formed inside a crankcase of said engine.

3. The internal combustion engine as defined in claim 1 including an oil guiding passage having one end connected to said pipe means other end and said oil guiding passage having another end which is led to said oil pan.

4. The internal combustion engine as defined in claim 2 including an oil guiding passage having one end connected to said pipe means other end and said oil guiding passage having another end which is led to said oil pan.

* * * * *